United States Patent [19]

Osthoff

[11] Patent Number: 4,627,135

[45] Date of Patent: Dec. 9, 1986

[54] BURNER UNIT FOR THE FLAME TREATMENT OF FLAT TEXTILE MATERIALS

[75] Inventor: Walter Osthoff, Wuppertal, Fed. Rep. of Germany

[73] Assignee: Osthoff Senge GmbH & Co. KG, Wuppertal, Fed. Rep. of Germany

[21] Appl. No.: 740,045

[22] PCT Filed: Sep. 29, 1984

[86] PCT No.: PCT/DE84/00200

§ 371 Date: May 29, 1985

§ 102(e) Date: May 29, 1985

[87] PCT Pub. No.: WO85/01529

PCT Pub. Date: Apr. 11, 1985

[30] Foreign Application Priority Data

Sep. 29, 1983 [DE] Fed. Rep. of Germany ..... 3335302

[51] Int. Cl.[4] ..... D06C 9/02

[52] U.S. Cl. ..... 26/3; 239/590.3; 239/600; 431/158

[58] Field of Search ..... 26/3; 28/174; 431/158; 239/590.3, 600

[56] References Cited

U.S. PATENT DOCUMENTS 2,675,067 4/1954 Hanson et al. ..... 26/3 X
3,721,517 3/1973 Osthoff ..... 26/3 X

FOREIGN PATENT DOCUMENTS 550895 9/1956 Belgium .
2023782 12/1971 Fed. Rep. of Germany ..... 26/3
434227 2/1968 Japan ..... 26/3
358403 1/1962 Switzerland .
557915 1/1975 Switzerland .
827303 2/1960 United Kingdom ..... 431/158

OTHER PUBLICATIONS

Melliand Textilberichte, 1982, issue 11, Nov. 9, 1982, Mellian Textilberichte KG, Heidelberg (DE), "Problematik des Sengens von Textilen Flachengebilden aus Polyester und Polyester-Mischungen", see pp. 794 to 797.

*Primary Examiner*—Robert R. Mackey
*Attorney, Agent, or Firm*—Antonelli, Terry & Wands

[57] ABSTRACT

A burner unit for a flame treatment of flat textile materials includes a combustion chamber terminating in a singeing slot supplied from a gas mixture chamber by two parallel burner slots, with the gas mixture chamber being encased by a burner element including two substantially U-shaped profile members clamped together along longitudinal edges with an interposition of mixture distributing rail for delimiting the burner slots respectively along a longitudinal side. To achieve a significant uniformity of the singeing flame in a longitudinal direction, the mixture distributing rail is enclosed between two guide strips respectively defining the outer longitudinal side of the burner slots, with the guide strips being clamped together with the mixture distributing rail, as a package, between the two substantially U-shaped profile members.

13 Claims, 4 Drawing Figures

BURNER UNIT FOR THE FLAME TREATMENT OF FLAT TEXTILE MATERIALS

BACKGROUND OF THE INVENTION

The present invention relates to a burner unit for the flame treatment of flat textile materials and, more particularly, to a burner unit for singeing machines, with a combustion chamber terminating in a singeing slot supplied from a gas mixture chamber by two parallel burner slots, and with the gas mixture chamber being encased by a burner element including two approximately U-shaped profile members clamped together along their longitudinal edges with an interposition of a mixture distributing rail respectively delimiting the burner slots along a longitudinal side.

A primary difficulty in the singeing of textile fabrics resides in effecting complete uniform singeing over an entire area of the fabric, because even minor spatial or temporal fluctuations during the singeing action can lead to undesirable patterns, such as, for example, spotting or streaking of the fabric. Regular singeing presupposes a flame that is extremely uniform over its length and stable against disturbing influences, the length of the singeing flame generally amounting to several meters. However, the singeing flame is very greatly dependent, inter alia, on the way in which the gas mixture is fed into the combustion chamber.

As compared with older burner designs with mixture feed via a single burner slot, a burner unit such as, for example, dislosed in German Pat. No. 2,023,782 has proven to be extraordinarily effective, under practical conditions, wherein two burner slots, arranged in parallel to each other, are provided, ensuring a temporally and locally extensively uniform feeding of the singeing flame. In the conventional burner unit, the outwardly disposed longitudinal sides of the two burner slots are in each case formed by the longitudinal sides of approximately U-shaped profile members surrounding a mixture distributing rail, these profile members encompassing the gas mixture chamber. During the machining of the longitudinal edges by milling, grinding, or the like, these edges, due to the shape and size of the profile, are perforce located at a relatively great distance from the clamping sites on the work table or the like, so that an elastic yielding in front of the machining tool cannot be avoided. Consequently, marked limits are set for the machining accuracy, i.e. certain dimensional tolerances and undulations in the surface and, therefore, certain spatial residual fluctuations in the singeing flame must be tolerated.

The aim underlying the present invention resides in providing a burner unit of the type discussed above wherein an especially high uniformity of the singeing flame is achieved in its longitudinal extension.

According to this invention, the mixture distributing rail is encased between two guide strips, respectively defining the other longitudinal side of the burner slots, these guide strips being clamped together with the mixture distributing rail as a package between the two U-shaped profile members. The invention offers the advantage that in this structure both sides of the burner slots are constituted by strips that can be machined with a substantially higher precision and uniformity. Consequently, a high surface quality of the burner slots and thus a clean flow of the gas mixture can be achieved. Any waviness in the longitudinal direction, still unavoidable in the manufacture of the U-shaped profile members, is now no longer effective directly on the contour of the burner slots; rather, such waviness is transmitted, at most, to a markedly reduced extent due to the interposed guide strips.

According to a preferred embodiment, the guide strips can exhibit a narrow bulge on their outer side, upstream of the burner slots, and they are clamped between the two U-shaped profile members at the site of this bulge. Consequently, the guide strips are in contact with the U-shaped profile members, in this arrangement, only along a narrowly limited area which furthermore is clearly distant from the zone of the burner slots. Irregularities on the longitudinal edges of the U-shaped profile members can be transmitted to the guide strips only along this narrow area, and fade very quickly toward the rims of the guide strips. Due to this feature, the precision of the burner slots now depends exclusively on the machining quality of the guide strips and of the mixture distributing rail; as a result, burner slots of extreme precision can be manufactured which even with small slot widths of about 0.25 mm do not exhibit any detectable nonuniformities.

According to this invention, each guide strip can be provided with a fitting lug on its contact surface facing the mixture distributing rail, and this fitting lug can engage into a corresponding counter groove in the mixture distributing rail. The fitting lug can preferably exhibit a V-shaped cross section. The guide strips and the mixture distributing rail, combined into a package, are placed into an unequivocal position relatively to each other, which is of great importance particularly with regard to the front edges of the burner slots. If these are not arranged in exact opposition, considerable irregularities can occur in the flow pattern. Centering of the guide strips on the mixture distributing rail with the aid of V-shaped lugs permits a simple and yet very precise assembly and does not pose any special manufacturing problems.

According to another feature of the invention, the mixture distributing rail can have a rectangular cross section with the rail being provided on each longitudinal side with a pressure-equalizing groove respectively in communication with a burner slot. The mixture distributing rail can exhibit blind bores emanating from the inlet and oriented in parallel to the clamping surfaces, with a diameter of these bores corresponding approximately to half the thickness of the mixture distributing rail, and with these bores intersecting the pressure-equalizing grooves along a width of respectively about 1/5 of their diameter. The blind bores can terminate into an inlet groove, with a width of the latter being equal to the diameter of the blind bores. An advantage of this embodiment resides in that it is very simple to manufacture as compared with conventional structures. Since the blind bores directly intersect the pressure-equalizing grooves, heretofore customary cross bores can be omitted. However, a more important factor for the function of the burner unit is that the blind bores exhibit a relatively large diameter, that there is no abrupt transition between the inlet groove and the blind bores, and that the flow during transition from the blind bores to the pressure-equalizing grooves is only moderately deflected so that, in total, a very uniform flow through the mixture distributing rail is attained. The ensuing uniform supply to the burner slots is, beside the manufacturing accuracy of the burner slots, of great importance for keeping the singeing flame free of disturbances.

According to a further feature of the invention, the two sidewalls of the inlet groove can exhibit recesses that are approximately of the shape of a circular arc in cross section. These recesses effect, in the flow direction, initially a gradual cross-sectional flaring and thereafter a gradual cross-sectional narrowing. As a result, an additional smoothing of the flow in the inlet zone of the mixture distributing rail is achieved.

The invention will be described in greater detail below with reference to the accompanying drawings.

DETAILED DESCRIPTION

Figure 1:
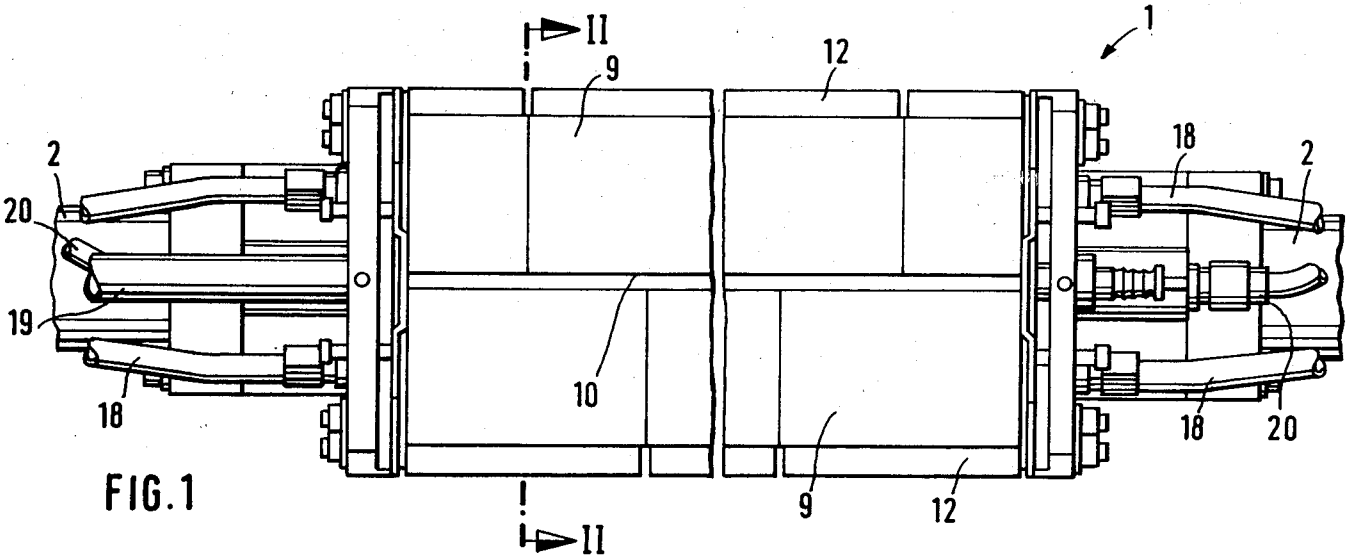
FIG. 1 is a frontal view, on a reduced scale, of a burner unit of the present invention.

FIG. 1 shows a burner unit generally designated by the reference numeral 1 which may be as long as several meters but is illustrated in the drawing only along a greatly shortened segment thereof. A gas mixture is introduced, by way of conduits 2, at the end faces of the burner unit 1 into a distributing chamber 3. The gaseous mixture exits via a choke stage 4 at increased velocity from the distributing chamber 3 and impinges on a filter 5 where solid impurities are separated. The gaseous mixture can calm down in a large-dimensioned expansion chamber or gas mixture chamber 6, respectively, and then pass along the entire length of the burner unit 1 through a mixture distributing rail 7 into a combustion chamber 8. The combustion chamber 8 is surrounded by burner rail blocks 9 forming in their forward zone the singeing slot 10. A length of textile material 11 is guided at high speed past the singeing slot 10. The burner rail blocks 9 are held at a burner element 13 by means of brackets 12. The burner element 13, in turn, includes two profile members 14 approximately U-shaped in cross section which latter are clamped together by means of clamping sleeves 15 and screws 16. The two profile members 14 thus form the walls of the distributing chamber 3 as well as of the gas mixture chamber 6. The U-shaped profile members 14 are moreover equipped with cooling channels 17 supplied with water by way of cooling conduits 18—compare FIG. 1.

FIG. 1 shows furthermore a flame monitor tube 19 as well as an adjusting means 20 serving to adjust a positioning of the flame monitor tube 19.

Figure 3:
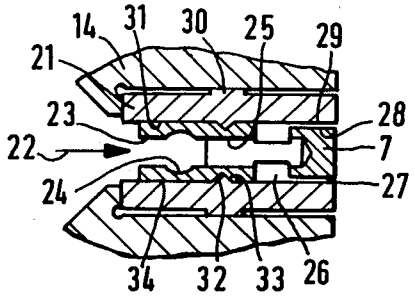
FIG. 3 is a cross-sectional view, on an enlarged scale, of a transitional zone from the gas mixture chamber to the combustion chamber of the burner unit in FIG. 2.
Figure 2:
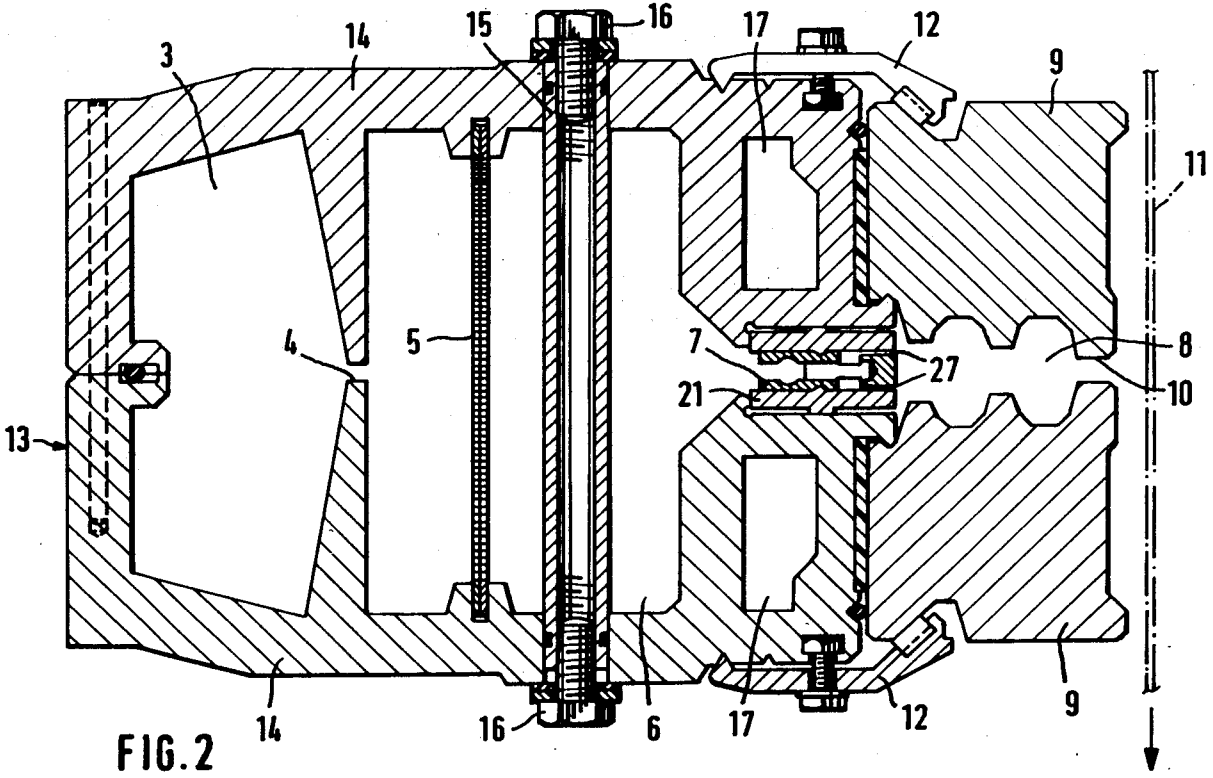
FIG. 2 is a cross-sectional view taken along the line II—II in FIG. 1.

FIG. 3 shows the mixture distributing rail 7 which, with the interposition of guide strips 21, is clamped in between the profile members 14. The gas mixture flows from the gas mixture chamber 6, in the direction of arrow 22, into an inlet groove 23 of the mixture distributing rail 7. The inlet groove 23 has approximately circular-arc-shaped recesses 24 along its two sidewalls, as seen in cross section. These recesses, after the relatively steep transition from the gas mixture chamber 6 into the inlet groove 23, contribute toward smoothing of the flow. The gas mixture then passes from the inlet groove 23 into blind bores 25, the diameter of which is equal to the width of the inlet groove 23. The blind bores 25 intersect, along a width of respectively 1/5 of their diameter, pressure-equalizing grooves 26 wherein the gas mixture can again be uniformly distributed along the entire length of the burner unit. Burner slots 27 adjoin the pressure-equalizing grooves 26, with the inner longitudinal side 28 of these burner slots being respectively delimited by the mixture distributing rail 7, and the outer longitudinal side 29 thereof is respectively delimited by a guide strip 21. The guide strips 21 exhibit, inwardly of the burner slots 27, a narrow bulge 30 on their outer sides, by means of which the strips are in contact with the longitudinal rims of the profile members 14. The compressive stresses transmitted by the profile members 14 to the guide strips 21 cannot affect the position and form of the longitudinal sides 29 in this embodiment, since these sides are far removed from the clamping zone. The guide strips 21 exhibit a fitting lug 32 on the contact surfaces 31 with the mixture distributing rail 7, with the lug 32 engaging into a corresponding counter groove 33 on the clamping faces 34 of the mixture distributing rail 7. The fitting lug 32, shown in FIG. 3 with a V-shaped cross section, centers the guide strips 21 with respect to the mixture distributing rail 7 so that, in particular, the forward edges of the burner slots 27 lie at the same level and accordingly ensure uniform efflux of the gas mixture.

The mixture distributing rail 7 is narrower in its forward zone defining the burner slots 27 than in its rearward clamping zone. The surface of the guide strips delimiting the outer side 29 of the burner slots lies in one plane with the contact surface 31 of the guide strips.

Alternatively, the burner slots 27 can also be formed by recesses at the guide strips 21, in which case the central distributing rail 7 can exhibit uniform thickness.

I claim:

1. Burner unit for the flame treatment of flat textile materials, especially a burner unit for singeing machines, with a combustion chamber terminating in a singeing slot supplied from a gas mixture chamber by way of two parallel burner slots, the gas mixture chamber being encased by a burner element including two substantially U-shaped profile members clamped together along their longitudinal edges with the interposition of a mixture distributing rail delimiting the burner slots respectively along an inner longitudinal side, characterized in that the mixture distributing rail is enclosed between two guide strips respectively defining the outer longitudinal side of the burner slots, the guide strips are clamped together with the mixture distributing rail as a package between the two substantially U-shaped profile members, and in that the guide strips include a narrow bulge upstream of the burner slots along their outer side, these strips being clamped in place between the two substantially U-shaped profile members at this bulge.

2. A burner unit according to claim 1, characterized in that each guide strip is provided with a fitting lug on a contact surface thereof facing the mixture distributing rail, and in that the fitting lug engages in a corresponding counter groove of the mixture distributing rail.

3. A burner unit according to claim 2, characterized in that the fitting lug has a substantially V-shaped cross-sectional configuration.

4. A burner unit according to claim 3, characterized in that the mixture distributing rail has an approximately rectangular cross-sectional configuration; that it is provided on each longitudinal side with a pressure-equalizing groove respectively in communication with one of the burner slots; the mixture distributing rail includes blind holes emanating from the inlet and oriented in parallel to the clamping faces thereof, said blind bores respectively intersecting both pressure equalizing grooves, and the diameter of the blind bores corresponding approximately to half a thickness of the mixture distributing rail.

5. A burner unit according to claim 4, characterized in that the blind bores emanate from an inlet groove, the inlet groove has a width equal to a diameter of the blind bores; and in that the two side walls of the inlet groove include recesses which are approximately of a circular arcuate shape in cross section.

6. A burner unit according to claim 1, characterized in that the mixture distributing rail has an approximately rectangular cross-sectional configuration; that it is provided on each longitudinal side with a pressure-equalizing groove respectively in communication with one of the burner slots; the mixture distributing rail includes blind holes emanating from the inlet and oriented in parallel to the clamping faces thereof, said blind bores respectively intersecting both pressure equalizing grooves, and the diameter of the blind bores corresponding approximately to half a thickness of the mixture distributing rail.

7. A burner unit according to claim 6, characterized in that the blind bores emanate from an inlet groove, the inlet groove has a width equal to a diameter of the blind bores; and in that the two side walls of the inlet groove include recesses which are approximately of a circular arcuate shape in cross section.

8. Burner unit for the flame treatment of flat textile materials, especially a burner unit for singeing machines, with a combustion chamber terminating in a singeing slot supplied from a gas mixture chamber by two parallel burner slots, the gas mixture chamber being encased by a burner element including two substantially U-shaped profile members clamped together along their longitudinal edges with the interposition of a mixture distributing rail delimiting the burner slots respectively along an inner longitudinal side, characterized in that the mixture distributing rail is enclosed between two guide strips respectively defining the outer longitudinal side of the burner slots, the guide strips being clamped together with the mixture distributing rail as a package between the two substantially U-shaped profile members, and in that each guide strip is provided with a fitting lug on its contact surface facing the mixture distributing rail, and that this fitting lug engages in a corresponding counter groove of the mixture distributing rail.

9. Burner unit according to claim 8, characterized in that the fitting lug exhibits a V-shaped cross section.

10. Burner unit according to claim 9, characterized in that the mixture distributing rail has an approximately rectangular cross section; that it is provided on each longitudinal side with a pressure-equalizing groove respectively in communication with one of the burner slots; and that the mixture distributing rail exhibits blind bores emanating from the inlet and oriented in parallel to the clamping faces thereof, these blind bores respectively intersecting both pressure-equalizing grooves, and the diameter of these blind bores corresponding approximately to half the thickness of the mixture distributing rail.

11. Burner unit according to claim 10, characterized in that the blind bores emanate from an inlet groove, the width of which is equal to the diameter of the blind bores; and that the two sidewalls of the inlet groove exhibit recesses which are approximately of the shape of a circular arc in cross section.

12. A burner unit according to claim 8, characterized in that the mixture distributing rail has an approximately rectangular cross-sectional configuration; that it is provided on each longitudinal side with a pressure-equalizing groove respectively in communication with one of the burner slots; the mixture distributing rail includes blind holes emanating from the inlet and oriented in parallel to the clamping faces thereof; said blind bores respectively intersecting both pressure equalizing grooves, and the diameter of the blind bores corresponding approximately to half a thickness of the mixture distributing rail.

13. A burner unit according to claim 12, characterized in that the blind bores emanate from an inlet groove, the inlet groove has a width equal to a diameter of the blind bores; and in that the two side walls of the inlet groove include recesses which are approximately of a circular arcuate shape in cross section.

* * * * *